United States Patent [19]

Morris

[11] 4,360,429

[45] Nov. 23, 1982

[54] APPARATUS FOR RECOVERING FLUIDS FLOATING ON WATER

[75] Inventor: David E. Morris, North Vancouver, Canada

[73] Assignee: Morris Industries Ltd., North Vancouver, Canada

[21] Appl. No.: 216,427

[22] Filed: Dec. 16, 1980

[51] Int. Cl.[3] ..... E02B 15/04

[52] U.S. Cl. ..... 210/242.3; 210/923

[58] Field of Search ..... 210/924, 923, 242.3, 210/150, 151

[56] References Cited

U.S. PATENT DOCUMENTS

| | | | |
|---|---|---|---|
| 1,264,635 | 4/1918 | Graham | 210/331 |
| 3,335,081 | 8/1967 | El-Naggar | 210/150 |
| 3,358,838 | 12/1967 | Kosar et al. | 210/242.3 |
| 3,860,519 | 1/1975 | Weatherford | 210/923 |
| 3,905,902 | 9/1975 | Hoeberg | 210/242.3 |
| 4,010,103 | 3/1977 | Morgan | 210/923 |
| 4,172,036 | 10/1979 | Morris | 210/924 |
| 4,269,719 | 5/1981 | Yamamoto | 210/150 |

*Primary Examiner*—Peter A. Hruskoci

*Attorney, Agent, or Firm*—Carver & Co.

[57] ABSTRACT

An apparatus for recovering fluids floating on a body of water comprises a support structure and two rows of discs mounted on the support structure so the discs are in contact with the fluid. The discs of each row are spaced-apart coaxially along a shaft. There is a motor coupled to the shafts for rotating the shafts and the discs. Wipers contact the sides of the discs for wiping the fluid from the discs as the discs rotate and collect the fluid. The shafts are parallel and spaced-apart a distance such that the discs of the two rows interdigitate.

21 Claims, 10 Drawing Figures

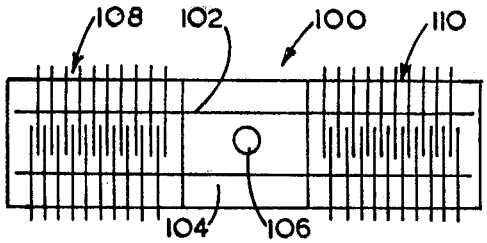
FIG 7
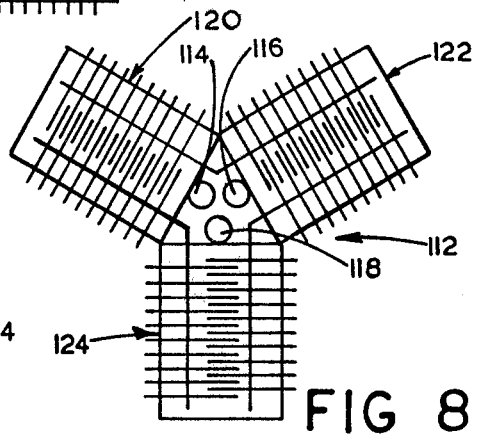
FIG 8
FIG 9
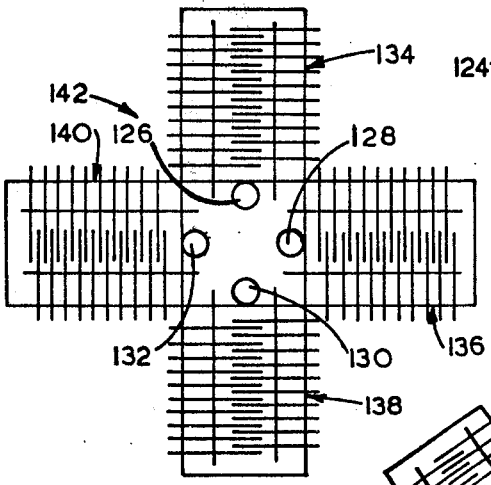
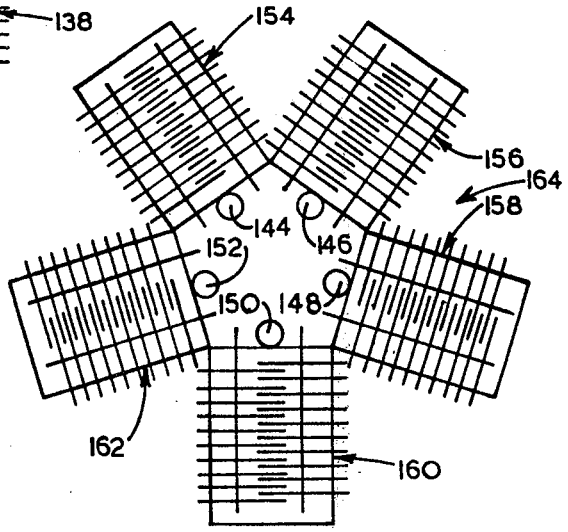
FIG 10

APPARATUS FOR RECOVERING FLUIDS FLOATING ON WATER

BACKGROUND OF THE INVENTION

This invention relates to an apparatus for recovering fluids floating on a body of water.

The removal of fluids, particularly petroleum products, floating on a body of water has become an important task in the protection of the environment. Various methods and devices have been suggested for the removal of such fluids including the use of floating oil skimmers. One type of floating oil skimmer includes a plurality of spaced-apart discs arranged coaxially along a rotatable shaft. The discs have lower portions immersed in the fluid which clings to the discs as they rotate. Wipers are provided to scrape the fluid from the discs and the fluid is then deflected into a collector system. While disc-type oil skimmers have been one of the most efficient means for removing spilled oil, the performance of such oil skimmers has not always achieved the desired level.

It is therefore desirable to provide an improved disc-type floating oil skimmer with a better level of performance and capable of operating for extended periods without extensive maintenance or repair. This calls for a relatively simple design employing proven components.

SUMMARY OF THE INVENTION

According to the invention, an apparatus for recovering fluids floating on a body of water comprises a support structure for maintaining the apparatus near the surface of the body of water and two rows of discs mounted on the support structure so the discs are in contact with the fluid when the apparatus is near the surface of the body of water. The discs of each said row are spaced-apart coaxially along a shaft means. A motor means is coupled to the shaft means for rotating the shaft means and the discs. Wiping means contact the sides of the discs for wiping the fluid from the discs as the discs rotate and collect the fluid. The shaft means for the rows of discs are parallel and spaced-apart a distance such that the discs of the two rows interdigitate.

The support structure may comprise float means for floating the apparatus on a body of water.

Preferably, the rows of discs are contra-rotatable by the motor means.

For example, where the discs of the rows interdigitate at a position midway between the shaft means of the rows, the discs may be rotatable by the motor means so the discs of both said rows rotate upwardly from the water at said position when the apparatus is near the surface of the body of water.

By providing at least two rows of discs which interdigitate, the invention allows more rows of discs to be fitted to a floating oil skimmer of a certain size. The increased number of rotating discs increases the volume of floating fluid which the apparatus can recover in a given time.

In addition to increasing the number of discs on the apparatus, contra-rotating the rows of discs so that the interdigitated portions of the discs move upwardly provides a unique pumping action. The spacing between the discs in a row must be sufficient to fit wipers between the discs to remove the oil or other fluid from the discs. The spacing between the interdigitated portions of the two rows of discs is one-half the spacing between the discs of a given row. The adhesion between the fluid and opposing surfaces of adjacent discs of the two rows causes the fluid to be pumped upwardly. The pumping action is appreciably greater than found with the wider spacing between discs of a single row and the amount of fluid clinging to the discs and brought to the wipers is significantly greater.

BRIEF DESCRIPTION OF THE DRAWINGS

FIGS. 7 to 10 are top plan views of alternative embodiments of the invention in simplified, diagrammatic form.

DESCRIPTION OF THE PREFERRED EMBODIMENTS

Figure 2:
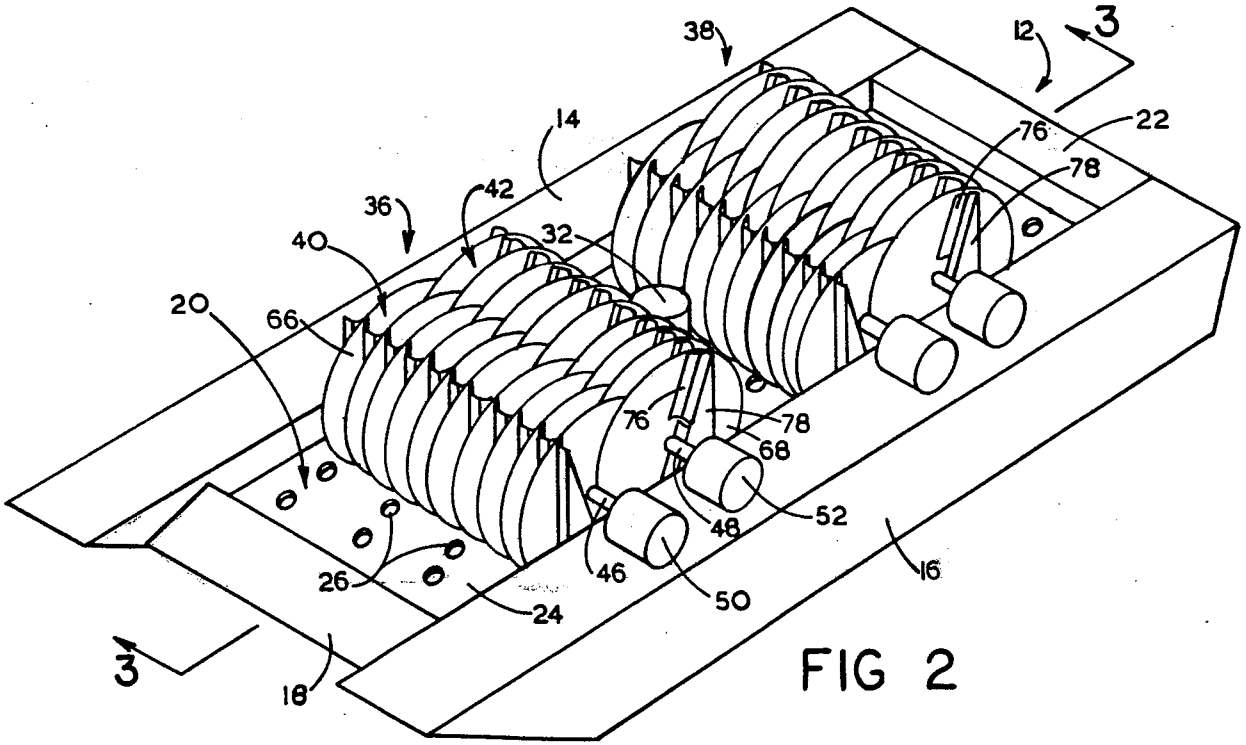
FIG. 2 is a simplified perspective view of an apparatus for recovering fluid, according to a second embodiment of the invention.

FIG. 2 illustrates in simplified form an apparatus 12 for recovering fluids floating on a body of water. A pair of spaced-apart, elongate floats 14 and 16 extend fore and aft on each side of the apparatus and serve as a support structure for maintaining the apparatus near the surface of a body of water. There is a weir 18 near the front end of the apparatus which serves as means for deflecting fluid into the pool 20 between the floats. The weir is generally horizontal and extends between the floats near the front end of the apparatus, but is hinged at its forward edge and angled downwardly towards the front end of the apparatus. Accordingly, as the apparatus is propelled forwardly through the water, the weir tends to lift the layer of fluid floating on the water and deflects it into the pool 20.

The pool 20 extends fore and aft between the weir 18 and the wall 22 at the stern of the apparatus and laterally between the floats 14 and 16. The pool 20 is, consequently, rectangular in shape and has a false bottom formed by the perforated plate 24. Plate 24 is perforated by a plurality of apertures 26 which comprise means for removing water from the pool. The water passing over weir 18 collects in the pool and passes through apertures 26 and collects in the sump 28, shown best in FIG. 3, which is below plate 24. A pump 30 powered by a hydraulic motor 32 has an intake in sump 28 and pumps water from the sump. The water passes through a suitable conduit and is discharged from the apparatus. As may be seen, therefore, the pool 20 contains substantially only the oil or other floating liquid.

Figure 3:
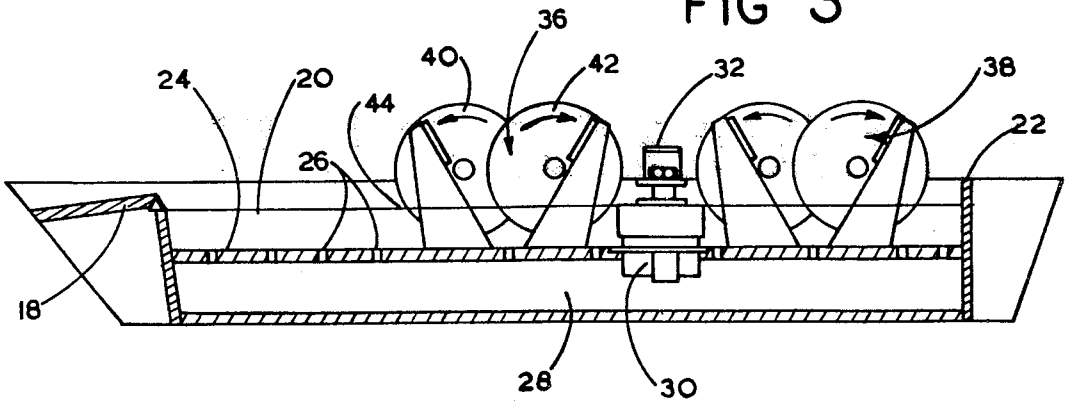
FIG. 3 is a sectional view taken along Line 3—3 of FIG. 2.

Apparatus 12 has two sets of rotatable discs 36 and 38. Both sets are identical, so only set 36 is described in detail. The set of discs 36 comprises two rows of discs 40 and 42 which are rotatably mounted on the floats 14 and 16 so that the lower portions of the discs are in contact with the fluid. This is best illustrated in FIG. 3 where the bottom portions of the discs are below the surface 44 of the fluid. Of course, the portions of the discs below the surface change as the discs rotate.

The discs of rows 40 and 42 are spaced-apart coaxially along shafts 46 and 48, respectively, which extend perpendicularly to the fore and aft direction of the floats. The discs are fixedly mounted on the shafts so they rotate when the shafts 46 and 48 are rotated by hydraulic motors 50 and 52 coupled to the shafts. The motors rotate in opposite directions so that the rows of discs are contra-rotated as illustrated by the arrows in FIG. 3 and FIG. 5.

Figure 4:
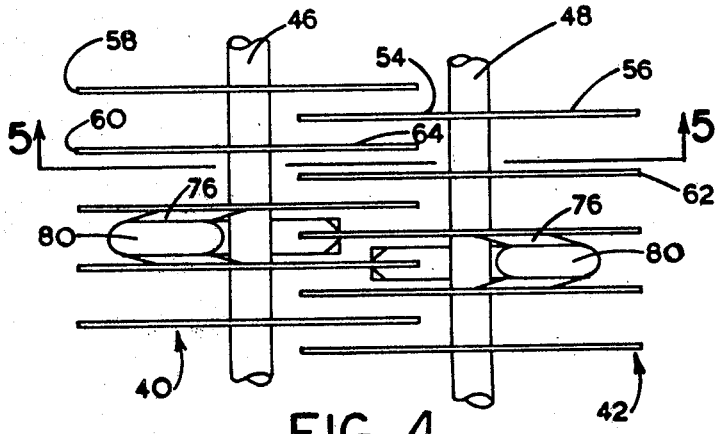
FIG. 4 is a top plan, fragmentary view of portions of the interdigitated rows of discs of the embodiment of FIG. 2.
Figure 5:
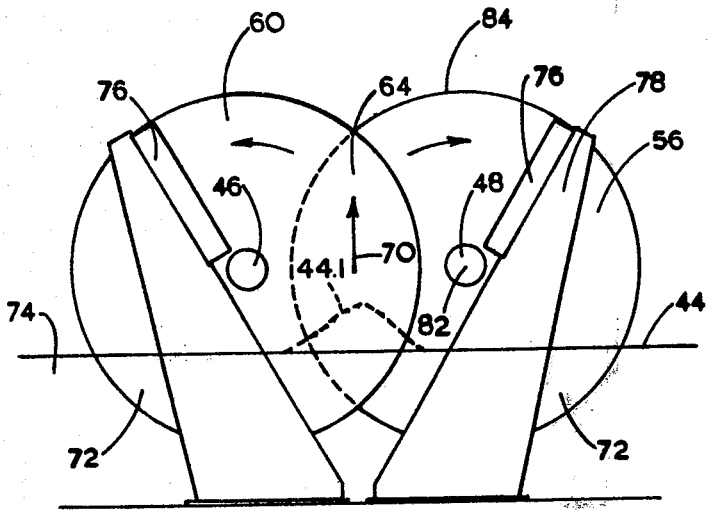
FIG. 5 is a side sectional view taken along Line 5—5 of FIG. 4.

As best appreciated from FIG. 2 and FIG. 4, the shafts 46 and 48 are spaced-apart a distance such that the discs of the two rows 40 and 42 interdigitate. The interdigitation results in a portion of the discs of one row extending between two adjacent discs of the other row. For example, portion 54 of disc 56 on row 42 extends between the two adjacent discs 58 and 60 of row 40. Similarly, portion 64 of disc 60 on row 40 extends between the adjacent discs 56 and 62 on row 42. FIG. 5 illustrates that the interdigitated portions, for example portion 64, represent double convex-shaped areas on both sides of each disc. While each row of discs has a plurality of discs each of which extends between two adjacent discs of the other row, the end discs 66 and 68 of rows 40 and 42 do not.

Referring to FIG. 5, the discs of the two rows are contra-rotated by motors 50 and 52 in rotational directions such that the discs rotate upwardly at a position 70 midway between the shafts 46 and 48. At any given rotational position, the discs have a lower portion 72 immersed in the fluid 74 as illustrated for discs 60 and 56 in FIG. 5. As the discs rotate, the fluid clings to the sides of the discs and is carried upwardly past position 70.

The apparatus 12 is provided with wiping means contacting the sides of the discs for wiping the fluid from the discs as the discs rotate. The wiping means comprises a plurality of identical resilient wiper blades 76 shown best in FIGS. 2, 4 and 5. The wiper blades are U-shaped and those between two discs of the same row wipe the opposing sides of the two discs. The blades are each connected to one of the collector channels 78 which are placed between the discs of each row and at the ends of each row of discs. The channels are upwardly tapering. The front of each of the channels is cut away near the top thereof to form an opening 80, as best seen in FIG. 4, through which the wiper blades project. The wiper blades are connected to the channels by means of bolts, rivets or other suitable fasteners. Referring to FIG. 5, it is apparent that the channels hold the blades 76 so the blades extend radially from near the centers 82 of the adjacent discs to near the top rotational positions 84 of the discs. The wiper blades are held in a downwardly inclined position so that the fluid wiped from the sides of the discs runs down the blades and into the channels. The channels are connected by suitable conduits, in the conventional manner, to a hydraulic pump capable of pumping the fluid to suitable storage adjacent apparatus 12.

Figure 6:
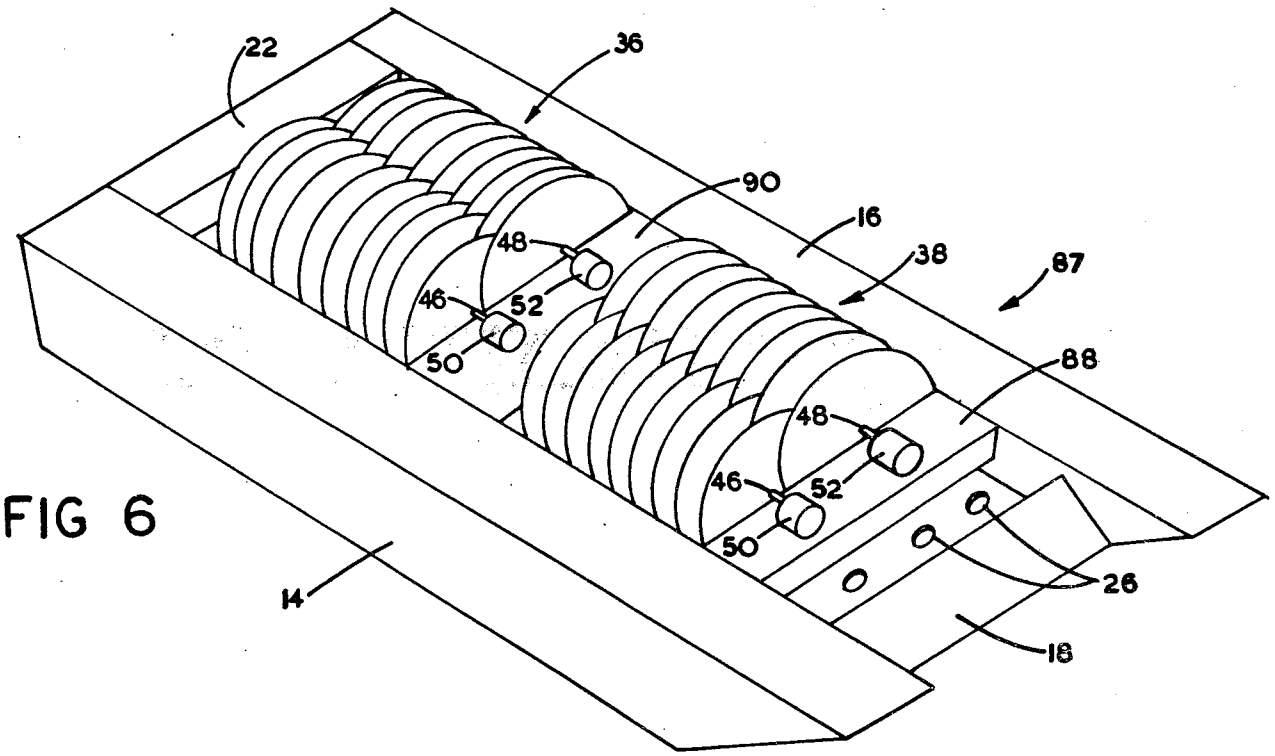
FIG. 6 is a simplified, perspective view of an apparatus for recovering fluids according to a third embodiment of the invention.

FIG. 6 illustrates another apparatus 87 for recovering fluids floating on a body of water. The components of apparatus 87 are generally identical to those in the embodiment of FIGS. 2 to 5 and so the same reference numbers are used. However, in apparatus 87, a pair of lateral supports 88 and 90 extend between the floats 14 and 16 near the fronts and middles thereof. The shafts 46 and 48 of the set of discs 36 extend between support 90 and wall 22 at the stern of the apparatus, while the hydraulic motors 50 and 52 are mounted on support 90. The corresponding shafts 46 and 48 of the set of discs 38 extend between support 88 and support 90 and the hydraulic motors 50 are mounted on support 88. Accordingly, the shaft of each of the rows of discs extends in the fore and aft direction parallel to floats 14 and 16.

Apparatus 12 of FIGS. 2 to 5 and apparatus 87 of FIG. 6 are all operated in the same manner. Each apparatus is moved forwardly through a body of water having a floating layer of oil or other fluid. The apparatus can be self-propelled or towed by another vessel as desired. As the bow or forward end of the apparatus moves through the water, the weir 18 acts as a pre-skimming device which makes an initial separation of the oil, or other fluid, and water. The oil is deflected into the pool 20 as the apparatus moves forward and any water passes downwardly through apertures 26 into the sump 28 and is discharged from the apparatus by means of pump 30. The discharged water may be sprayed in front of the apparatus to break the oil slick and perform an "oil herding" operation. The oil collecting in pool 20 covers the bottom portions of the discs as seen in FIG. 3. As the discs rotate, the oil clings to the sides of the discs and is carried towards the wipers 76.

Figure 1:
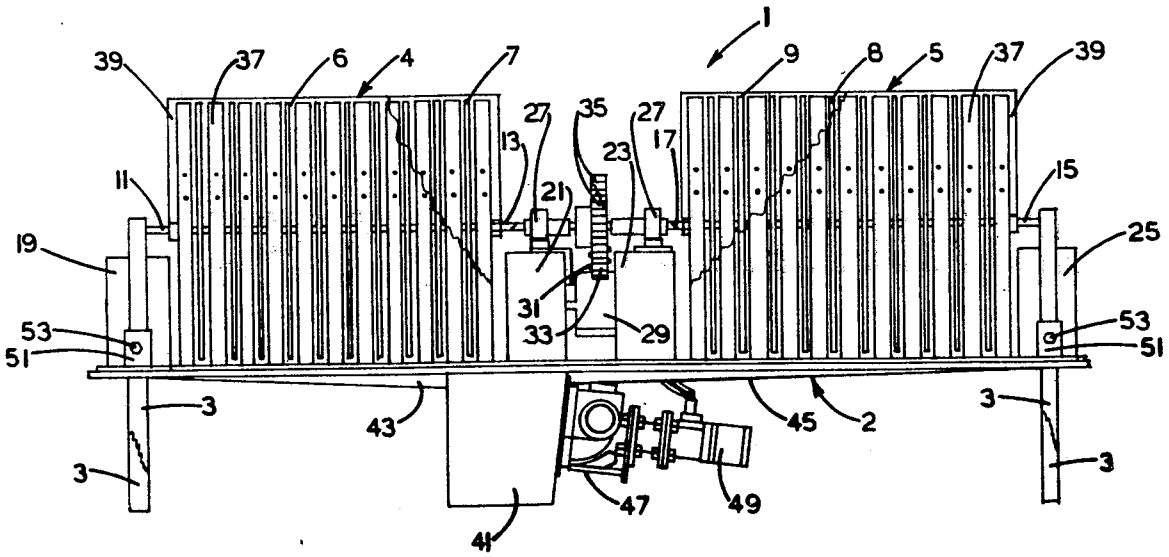
FIG. 1 is an elevational view, partly broken away, of an apparatus for recoverying fluid, according to a first embodiment of the invention.

FIG. 1 shows an apparatus 1 for recovering fluids floating on a body of water according to a further embodiment of the invention. This apparatus is generally similar to the apparatuses shown in FIGS. 2 to 6, but lacks floats. Instead, a frame 2 and four legs 3 connected thereto serve as the support structure for maintaining the apparatus near the surface of a body of water. This embodiment is particularly adapted for use in relatively small pools or sumps and the legs 3 extend to the bottom of a pool or sump, while the rest of the apparatus is near the surface.

Apparatus 1 has two recovering modules comprising interdigitated sets of discs 4 and 5 generally similar in arrangement to the sets of discs 36 and 38 shown in FIG. 6. The set of discs 4 consists of two rows 6 and 7, while the sets of discs 5 consists of two interdigitated rows 8 and 9. The discs of rows 6 and 7 are provided with drive shafts 11 and 13, respectively, while the discs of rows 8 and 9 are provided with drive shafts 15 and 17, respectively. The frame 2 includes a first pair of spaced-apart supports 19 and 21, for the shafts 11 and 13, and a second pair of spaced-apart supports 23 and 25 for the shafts 15 and 17. The shafts are rotatably mounted at each end in bearings supported by one of the pillow blocks 27 mounted on the shaft supports. The two sets of discs 4 and 5 are contra-rotated by a single hydraulic motor 29 between supports 21 and 23. The hydraulic motor is operatively connected to the shafts by a set of gears comprising worm gear 31 mounted on the motor and a pair of spur gears 33 and 35. Spur gear 33 is mounted on the two drive shafts 11 and 15, while spur gear 35 is mounted on the drive shaft 13 and 17. The spur gears mesh with the worm gear, so the hydraulic motor is capable of conta-rotating the two rows of each of the sets of discs.

Instead of the collector channels employed on the other embodiments, apparatus 1 includes a plurality of collector tubes 37 between the discs, each provided with a wiper blade 39 for wiping fluid from the discs as they rotate. The specific structure may be understood by reference to the other embodiments.

Frame 2 is, in this preferred embodiment, a unitary structure of glass fiber reinforced plastic including the drive shaft supports, a sump 41 and a pair of internal, sloping conduits 43 and 45 for carrying fluid from the collector channels to the sump 41. A pump 47, driven by another hydraulic motor 49, is connected to the sump for pumping fluid from the sump to a convenient storage location.

The leg 3 at each of the four corners of the frame 2 extends through a short length of tubing 51. The height of the legs can be adjusted by means of a set screw 53 extending through each of the tubes 51. The height of the legs is adjusted according to the depth of the water in the pool or sump.

The operation of apparatus 1 is generally the same as the alternative embodiments shown in FIGS. 2 and 6 except that the apparatus remains stationary and supported on legs 3 instead of floating on the water.

The pumping action caused by the interdigitated discs of the two rows is illustrated in FIG. 5. The oil between the interdigitated portions 64 of adjacent discs of the two rows 40 and 42 is pumped upwardly. This pumping action is due to the upwards rotation of the interdigitated portions of both rows of discs because of the contra-rotation of the rows of discs as illustrated by the arrows in FIG. 5 and because of the closer spacing of the discs compared to conventional arrangements without interdigitation. As mentioned above, the interdigitated portions of the discs are spaced one-half the distance apart when compared with the discs of a given row in a conventional disc-type oil skimmer. The interdigitated portions are thus $\frac{3}{4}''$ apart where discs along each of the rows are $1\frac{1}{2}''$ apart. The oil is supported by discs on both sides as it is carried up. This initial lift, illustrated by the broken line 44.1 in FIG. 5, is important. Once the oil is moving upwards, the surface tension is broken and the oil keeps moving towards the wipers 76. When the oil clinging to the discs reaches the wipers 76, it is scraped off the discs and drains down the wipers into the channels 78 and through suitable conduits to a storage location.

It should be understood that the use of contra-rotating, interdigitated rows of discs according to the invention is not limited to the specific arrangements shown in the drawings. Such interdigitated rows of discs can be employed on other devices used to remove floating oil or other fluid from water. For example, FIGS. 7 to 10 show alternative arrangements of apparatuses employing sets of contra-rotating rows of discs for recovering fluids floating on a body of water. In FIG. 7, apparatus 100 has two continuous shafts 102 and 104 connected to a motor 106 to drive two sets of discs 108 and 110. FIG. 8 shows an apparatus 112 where three motors 114, 116 and 118 drive three sets of discs 120, 122, and 124. Four motors 126, 128, 130 and 132 drive four sets of discs 134, 136, 138 and 140 in the cross-shaped apparatus 142 of FIG. 9. Similarly, five motors 144, 146, 148, 150 and 152 drive five sets of discs 154, 156, 158, 160 and 162 in apparatus 164 of FIG. 10. Apparatus 100 of FIG. 7 could be used with a non-floating support structure similar to that of FIG. 1 or, with suitable modifications, as a floating device similar to FIGS. 2, 3 and 6. Apparatuses 112, 142 and 164 are suitable as floating devices.

It may be appreciated that each of the embodiments has means for supporting the discs so each disc has a lower portion in contact with the fluid and an upper portion above the surface of the fluid and the water. This means comprises, for example, the floats 14 and 16 of FIG. 2 and the leg 3 and frame 2 of FIG. 1.

What is claimed is:

1. An apparatus for recovering fluids floating on a body of water, the apparatus comprising:
   (a) two rows of discs, the discs of each said row being spaced-apart coaxially along a shaft means;
   (b) means for supporting the rows of discs so each of the discs has a lower portion in contact with the fluid and an upper portion above the surface of the fluid;
   (c) motor means coupled to the shaft means for rotating the shaft means and the discs; and
   (d) wiping means contacting the upper portions of the discs for wiping the fluid carried upwards by the discs as the discs rotate and for collecting the fluid wherein the wiping means comprises resilient wiper blades contacting the sides of the discs and a collector channel between adjacent discs of each said row, the wiper blades being mounted on the channels to deflect the fluid into the channels, and wherein each said disc has a top rotational position, each said wiper blade extending radially from near the center of an adjacent said disc to near the top rotational position;
   (e) the shaft means for the rows of discs being parallel and spaced-apart a distance such that the discs of said two rows interdigitate, the two rows of discs being contra-rotatable by the motor means and adjacent discs being spaced-apart a distance such that the fluid between the adjacent discs is raised towards the wiping means by a pumping action which lifts the fluid an initial distance towards the wiping means.

2. An apparatus as claimed in claim 1, wherein each disc of a plurality of discs of a first said row has a portion extending between two adjacent discs of a second said row and each said disc of a plurality of discs of the second row has a portion extending between two adjacent discs of the first row.

3. An apparatus as claimed in claim 1, wherein the discs of the rows interdigitate at a position midway between the shaft means of the rows, the discs being rotatable by the motor means so the discs of both said rows rotate upwardly away from the water at said position when the apparatus is near the surface of the body of water.

4. An apparatus as claimed in claim 3, wherein the means for supporting comprises a frame including supports for the shaft means, a sump and a conduit for carrying fluid from the wiping means to the sump.

5. An apparatus as claimed in claim 4, wherein the unitary frame is of glass fiber reinforced plastic.

6. An apparatus as claimed in claim 4, wherein the motor means comprises a hydraulic motor, the apparatus further comprising gears operatively connecting the hydraulic motor to the shaft means.

7. An apparatus as claimed in claim 6, wherein the shaft means comprises a drive shaft for each of the rows of discs, the gears comprising a spur gear mounted on each drive shaft and a worm gear mounted on the hydraulic motor between the spur gears and meshing with the spur gears.

8. An apparatus as claimed in claim 7, comprising a pump connected to the sump.

9. An apparatus as claimed in claim 4, wherein the means for supporting further comprises adjustable legs connected to the frame for supporting the frame and discs near the surface of the water.

10. An apparatus as claimed in claim 1, wherein the discs of each said row are generally one and one-half inches apart.

11. An apparatus as claimed in claim 1, wherein the motor means comprises a hydraulic motor coupled to one end of each said shaft means.

12. An apparatus as claimed in claim 1, wherein the shaft means comprises a drive shaft extending through the centers of the discs of each said row.

13. An apparatus as claimed in claim 1, wherein the means for supporting comprises a pair of spaced-apart floats extending fore and aft on each side of the apparatus, the rows of discs being mounted between the floats.

14. An apparatus as claimed in claim 13 comprising a pool for the fluid between the floats, the discs being mounted on the floats so that the bottom portions of the discs are immersed in the fluid within the pool as the discs rotate.

15. An apparatus as claimed in claim 14, having a front end and comprising means for deflecting fluid into the pool when the apparatus moves forwardly in the body of water.

16. An apparatus as claimed in claim 15, wherein the means for deflecting comprises a generally horizontal weir extending between the floats near the front end of the apparatus, the weir being hinged at its forward edge and angled downwardly towards the front end of the apparatus.

17. An apparatus as claimed in claim 14 comprising means for removing water from the pool comprising a false bottom below the discs, apertures through the false bottom, a sump below the false bottom for collecting water passing through the apertures and a pump having an intake in the sump for pumping water from the sump.

18. An apparatus as claimed in claim 13, wherein the rows of discs are mounted on the floats so the shaft means are in the fore and aft direction.

19. An apparatus as claimed in claim 13, wherein the rows of discs are mounted on the floats so the shaft means are perpendicular to the fore and aft direction.

20. An apparatus as claimed in claim 1, wherein the means for supporting comprises float means for floating the apparatus on the body of water.

21. An apparatus as claimed in claim 1, wherein the means for supporting comprises a frame.

* * * * *